US006742596B2

(12) United States Patent
Haugen

(10) Patent No.: US 6,742,596 B2
(45) Date of Patent: Jun. 1, 2004

(54) APPARATUS AND METHODS FOR TUBULAR MAKEUP INTERLOCK

(75) Inventor: David M. Haugen, League City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/860,127

(22) Filed: May 17, 2001

(65) Prior Publication Data

US 2002/0170720 A1 Nov. 21, 2002

(51) Int. Cl.[7] ..... E21B 19/16

(52) U.S. Cl. ..... 166/380; 166/77.53; 166/85.1; 166/377

(58) Field of Search ..... 166/377, 378, 166/380, 77.51, 77.52, 77.53, 85.1; 175/85; 294/86.24, 86.25

(56) References Cited

U.S. PATENT DOCUMENTS

| | | | |
|---|---|---|---|
| 1,917,135 A | 7/1933 | Littell | |
| 3,041,901 A | 7/1962 | Knights | 81/53 |
| 3,193,116 A | 7/1965 | Kennedy et al. | 214/2.5 |

(List continued on next page.)

FOREIGN PATENT DOCUMENTS

| | | | |
|---|---|---|---|
| EP | 01 62000 A1 | 11/1985 | E21B/19/16 |
| EP | 0 171 144 A1 | 2/1986 | E21B/19/06 |
| EP | 0 285 386 | 10/1988 | E21B/19/16 |
| EP | 0 525 247 A1 | 2/1993 | E21B/3/02 |
| EP | 0 589 823 A1 | 2/1993 | E21B/19/06 |
| EP | 0 659 975 | 6/1995 | E21B/43/08 |
| GB | 2 224 481 A | 9/1990 | B66C/1/56 |
| GB | 2 275 486 A | 4/1993 | E21B/37/00 |
| GB | 2 357 530 | 6/2001 | E21B/19/07 |
| WO | WO 93/07358 | 4/1993 | E21B/37/00 |
| WO | WO 96/18799 | 6/1996 | E21B/19/16 |
| WO | WO 98/05844 | 2/1998 | E21B/19/16 |
| WO | WO 98/32948 | 7/1998 | E21B/19/16 |
| WO | WO 98/11322 | 9/1998 | E21B/19/16 |
| WO | WO 00/05483 * | 2/2000 | |
| WO | WO 00/11309 | 3/2000 | E21B/19/16 |
| WO | WO 00/11310 | 3/2000 | E21B/19/16 |
| WO | WO 00/11311 | 3/2000 | E21B/19/16 |
| WO | WO 00/39429 | 7/2000 | E21B/19/16 |
| WO | WO 00/39430 | 7/2000 | E21B/19/16 |

OTHER PUBLICATIONS

International Preliminary Examination Report from International Application No. PCT/GB01/01736, dated May 07, 2002.

WEAA, 417A–UK; 7/98; GB; Pietras: An Apparatus For Facilitating The Connection Of Tubulars Using A Top Drive, undated.

WEAA, 417B–UK; 7/98; GB; Pietras: An Apparatus For Facilitating The Connection Of Tubulars Using A Top Drive, undated.

WEAA, 417C–UK; 7/98; GB; Pietras: Methods & Apparatus For Facilitating The Connection Of Tubulars Using A Top Drive, undated.

WEAA, 417D–UK; 7/98; GB; Pietras: Method & Apparatus For Facilitating The Connection Of Tubulars Using A Top Drive, undated.

(List continued on next page.)

*Primary Examiner*—Zakiya Walker
(74) *Attorney, Agent, or Firm*—Moser, Patterson & Sheridan, L.L.P.

(57) ABSTRACT

An apparatus and methods to prevent an operator from inadvertently dropping a string into a wellbore during assembling and disassembling of tubulars. Additionally, the apparatus and methods can be used for running in casing, running in wellbore components or for a drill string.

33 Claims, 8 Drawing Sheets

U.S. PATENT DOCUMENTS

| | | | | | |
|---|---|---|---|---|---|
| 3,380,528 | A | | 4/1968 | Timmons | 166/14 |
| 3,566,505 | A | | 3/1971 | Martin | 29/200 |
| 3,570,598 | A | | 3/1971 | Johnson | 166/178 |
| 3,635,105 | A | | 1/1972 | Dickmann et al. | 81/57.18 |
| 3,691,825 | A | | 9/1972 | Dyer | 73/136 A |
| 3,747,675 | A | | 7/1973 | Brown | 166/237 |
| 3,766,320 | A | | 10/1973 | Homme | 179/5 R |
| 3,776,991 | A | | 12/1973 | Marcus | 264/89 |
| 3,848,684 | A | | 11/1974 | West | 175/195 |
| 3,857,450 | A | | 12/1974 | Guier | 175/85 |
| 3,913,687 | A | | 10/1975 | Gyongyosi et al. | 175/85 |
| 4,100,968 | A | | 7/1978 | Delano | 166/315 |
| 4,320,915 | A | | 3/1982 | Abbott et al. | 294/96 |
| 4,437,363 | A | | 3/1984 | Haynes | 81/57.18 |
| 4,449,596 | A | | 5/1984 | Boyadjieff | 175/85 |
| 4,494,424 | A | | 1/1985 | Bates | 81/57.18 |
| 4,529,045 | A | | 7/1985 | Boyadjieff et al. | 173/164 |
| 4,570,706 | A | | 2/1986 | Pugnet | 166/77.5 |
| 4,593,773 | A | | 6/1986 | Skeie | 175/85 |
| 4,604,724 | A | * | 8/1986 | Shaginian et al. | 700/213 |
| 4,605,077 | A | | 8/1986 | Boyadjieff | 175/85 |
| 4,625,796 | A | | 12/1986 | Boyadjieff | 166/77.5 |
| 4,649,777 | A | | 3/1987 | Buck | 81/57.19 |
| 4,676,312 | A | | 6/1987 | Mosing et al. | 166/77 |
| 4,683,962 | A | | 8/1987 | True | 173/163 |
| 4,709,599 | A | | 12/1987 | Buck | 81/57.18 |
| 4,742,876 | A | | 5/1988 | Barthelemy et al. | 175/7 |
| 4,759,239 | A | | 7/1988 | Hamilton et al. | 81/57.34 |
| 4,762,187 | A | | 8/1988 | Haney | 175/171 |
| 4,765,401 | A | * | 8/1988 | Boyadjieff | 166/77.53 |
| 4,773,689 | A | | 9/1988 | Wolters | 294/88 |
| 4,791,997 | A | | 12/1988 | Krasnov | 175/57 |
| 4,793,422 | A | | 12/1988 | Krasnov | 175/57 |
| 4,800,968 | A | | 1/1989 | Shaw et al. | 175/85 |
| 4,813,493 | A | | 3/1989 | Shaw et al. | 173/164 |
| 4,836,064 | A | | 6/1989 | Slator | 81/57.18 |
| 4,867,236 | A | | 9/1989 | Haney et al. | 166/77.5 |
| 4,878,546 | A | | 11/1989 | Shaw et al. | 173/163 |
| 4,997,042 | A | | 3/1991 | Jordan et al. | 166/379 |
| 5,009,265 | A | | 4/1991 | Bailey et al. | 166/118 |
| 5,036,927 | A | | 8/1991 | Willis | 175/162 |
| 5,191,939 | A | | 3/1993 | Stokley | 166/379 |
| 5,251,709 | A | | 10/1993 | Richardson | 175/220 |
| 5,255,751 | A | | 10/1993 | Stogner | 175/203 |
| 5,282,653 | A | | 2/1994 | LaFleur et al. | 285/110 |
| 5,297,833 | A | | 3/1994 | Willis et al. | 294/102.2 |
| 5,351,767 | A | | 10/1994 | Stogner et al. | 175/162 |
| 5,388,651 | A | | 2/1995 | Berry | 175/85 |
| 5,433,279 | A | | 7/1995 | Tessari et al. | 173/213 |
| 5,501,286 | A | | 3/1996 | Berry | 175/52 |
| 5,503,234 | A | | 4/1996 | Clanton | 175/52 |
| 5,553,672 | A | | 9/1996 | Smith, Jr. et al. | 166/382 |
| 5,577,566 | A | | 11/1996 | Albright et al. | 175/321 |
| 5,584,343 | A | | 12/1996 | Coone | 166/387 |
| 5,645,131 | A | | 7/1997 | Trevisani | 175/171 |
| 5,735,348 | A | | 4/1998 | Hawkins, III | 166/285 |
| 5,791,410 | A | | 8/1998 | Castille et al. | 166/77.1 |
| 5,803,191 | A | | 9/1998 | Mackintosh | 175/170 |
| 5,836,395 | A | | 11/1998 | Budde | 166/321 |
| 5,909,768 | A | | 6/1999 | Castille et al. | 166/77.1 |
| 5,971,079 | A | | 10/1999 | Mullins | 166/387 |
| 6,000,472 | A | | 12/1999 | Albright et al. | 166/380 |
| 6,056,060 | A | * | 5/2000 | Abrahamsen et al. | 166/380 |
| 6,070,500 | A | | 6/2000 | Dlask et al. | 81/57.33 |
| 6,199,641 | B1 | | 3/2001 | Downie et al. | 173/55 |
| 6,309,002 | B1 | * | 10/2001 | Bouligny | 294/86.25 |
| 6,311,792 | B1 | | 11/2001 | Scott et al. | 175/162 |
| 6,349,764 | B1 | | 2/2002 | Adams et al. | 166/77.53 |
| 6,360,633 | B2 | | 3/2002 | Pietras | 81/57.34 |
| 6,412,554 | B1 | | 7/2002 | Allen et al. | 166/80.1 |
| 6,431,626 | B1 | | 8/2002 | Bouligny | 294/86.25 |
| 2001/0042625 | A1 | | 11/2001 | Appleton | 166/379 |
| 2002/0134555 | A1 | | 9/2002 | Allen et al. | 166/377 |

OTHER PUBLICATIONS

Autoseal Circulating Head: LaFleur Petroleum Services; 1992.

Valves, Wellhead Equipment, Safety System; W–K–M Division, ACF Industries, 1980.

Top Drive Drilling Systems, Canrig, Feb. 97 in Hart's Petroleum Engineer.

More Portable Top Drive Installations, Tesco Drilling Technology, 1997.

Portable Top Drives, Drilling Contractor, Cover & 3pp. Sep. 1994.

500 or 650 HCIS Top Drive, Tesco Drilling Technology, 4/98.

500 650 ECIS Top Drive, Tesco Drilling Technology, 4/98.

Product Information, (Sections 1–10) Canrig, 1996.

* cited by examiner

900
CONTROLLER
270
250
142
500
660
662
664
260
630
640
650
200
642
370
995
140
980
970
632
210
622
340
610
620
400
430
160
990
420
410
690
692

APPARATUS AND METHODS FOR TUBULAR MAKEUP INTERLOCK

BACKGROUND OF THE INVENTION

1. Field of the Invention

The present invention relates to an apparatus and methods for facilitating the connection of tubulars. More particularly, the invention relates to an interlock system for a top drive and a spider for use in assembling or disassembling tubulars.

2. Background of the Related Art

In the construction and completion of oil or gas wells, a drilling rig is constructed on the earth's surface to facilitate the insertion and removal of tubular strings into a wellbore. The drilling rig includes a platform and power tools such as an elevator and a spider to engage, assemble, and lower the tubulars into the wellbore. The elevator is suspended above the platform by a draw works that can raise or lower the elevator in relation to the floor of the rig. The spider is mounted in the platform floor. The elevator and spider both have slips that are capable of engaging and releasing a tubular, and are designed to work in tandem. Generally, the spider holds a tubular or tubular string that extends into the wellbore from the platform. The elevator engages a new tubular and aligns it over the tubular being held by the spider. A power tong and a spinner are then used to thread the upper and lower tubulars together. Once the tubulars are joined, the spider disengages the tubular string and the elevator lowers the tubular string through the spider until the elevator and spider are at a predetermined distance from each other. The spider then re-engages the tubular string and the elevator disengages the string and repeats the process. This sequence applies to assembling tubulars for the purpose of drilling, running casing or running wellbore components into the well. The sequence can be reversed to disassemble the tubular string.

During the drilling of a wellbore, a drill string is made up and is then necessarily rotated in order to drill. Historically, a drilling platform includes a rotary table and a gear to turn the table. In operation, the drill string is lowered by an elevator into the rotary table and held in place by a spider. A Kelly is then threaded to the string and the rotary table is rotated, causing the Kelly and the drill string to rotate. After thirty feet or so of drilling, the Kelly and a section of the string are lifted out of the wellbore, and additional drill string is added.

The process of drilling with a Kelly is expensive due to the amount of time required to remove the Kelly, add drill string, reengage the Kelly, and rotate the drill string. In order to address these problems, top drives were developed.

FIG. 1A is a side view of an upper portion of a drilling rig 100 having a top drive 200 and an elevator 120. An upper end of a stack of tubulars 130 is shown on the rig 100. The figure shows the elevator 120 engaged with a tubular 130. The tubular 130 is placed in position below the top drive 200 by the elevator 120 in order for the top drive with its gripping means to engage the tubular.

FIG. 1B is a side view of a drilling rig 100 having a top drive 200, an elevator 120, and a spider 400. The rig 100 is built at the surface 170 of the well. The rig 100 includes a travelling block 110 that is suspended by wires 150 from draw works 105 and holds the top drive 200. The top drive 200 has a gripping means for engaging the inner wall of tubular 130 and a motor 240 to rotate the tubular 130. The motor 240 rotates and threads the tubular 130 into the tubular string 210 extending into the wellbore 180. The motor 240 can also rotate a drill string having a drill bit at an end, or for any other purposes requiring rotational movement of a tubular or a tubular string. Additionally, the top drive 200 is shown with elevator 120 and a railing system 140 coupled thereto. The railing system 140 prevents the top drive 200 from rotational movement during rotation of the tubular string 210, but allows for vertical movement of the top drive under the travelling block 110.

In FIG. 1B, the top drive 200 is shown engaged to tubular 130. The tubular 130 is positioned above the tubular string 210 located therebelow. With the tubular 130 positioned over the tubular string 210, the top drive 200 can lower and thread the tubular into the tubular string. Additionally, the spider 400, disposed in the platform 160, is shown engaged around a tubular string 210 that extends into wellbore 180.

FIG. 2 illustrates a side view of a top drive engaged to a tubular, which has been lowered through a spider. As depicted in the Figure, the elevator 120 and the top drive 200 are connected to the travelling block 110 via a compensator 270. The compensator 270 functions similar to a spring to compensate for vertical movement of the top drive 200 during threading of the tubular 130 to the tubular string 210. In addition to its motor 240, the top drive includes a counter 250 to measure rotation of the tubular 130 during the time tubular 130 is threaded to tubular string 210. The top drive 200 also includes a torque sub 260 to measure the amount of torque placed on the threaded connection between the tubular 130 and the tubular string 210. The counter 250 and the torque sub 260 transmit data about the threaded joint to a controller via data lines (not shown). The controller is preprogrammed with acceptable values for rotation and torque for a particular joint. The controller compares the rotation and the torque data to the stored acceptable values.

FIG. 2 also illustrates a spider 400 disposed in the platform 160. The spider 400 comprises a slip assembly 440, including a set of slips 410, and piston 420. The slips 410 are wedge-shaped and are constructed and arranged to slidably move along a slopped inner wall of the slip assembly 440. The slips 410 are raised or lowered by piston 420. When the slips 410 are in the lowered position, they close around the outer surface of the tubular string 210. The weight of the tubular string 210 and the resulting friction between the tubular string 210 and the slips 410, forces the slips downward and inward, thereby tightening the grip on the tubular string. When the slips 410 are in the raised position as shown, the slips are opened and the tubular string 210 is free to move axially in relation to the slips.

FIG. 3 is cross-sectional view of a top drive 200 and a tubular 130. The top drive 200 includes a gripping means having a cylindrical body 300, a wedge lock assembly 350, and slips 340 with teeth (not shown). The wedge lock assembly 350 and the slips 340 are disposed around the outer surface of the cylindrical body 300. The slips are constructed and arranged to mechanically grip the inside of the tubular 130. The slips 340 are threaded to piston 370 located in a hydraulic cylinder 310. The piston is actuated by pressurized hydraulic fluid injected through fluid ports 320, 330. Additionally, springs 360 are located in the hydraulic cylinder 310 and are shown in a compressed state. When the piston 370 is actuated, the springs decompress and assist the piston in moving the slips 340. The wedge lock assembly 350 is constructed and arranged to force the slips against the inner wall of the tubular 130 and moves with the cylindrical body 300.

In operation, the slips 340, and the wedge lock assembly 350 of top drive 200 are lowered inside tubular 130. Once the slips 340 are in the desired position within the tubular 130, pressurized fluid is injected into the piston through fluid port 320. The fluid actuates the piston 370, which forces the slips 340 towards the wedge lock assembly 350. The wedge lock assembly 350 functions to bias the slips 340 outwardly as the slips are slidably forced along the outer surface of the assembly, thereby forcing the slips to engage the inner wall of the tubular 130.

FIG. 4 illustrates a cross-sectional view of a top drive 200 engaged to a tubular 130. The figure shows slips 340 engaged with the inner wall of the tubular 130 and a spring 360 in the decompressed state. In the event of a hydraulic fluid failure, the springs 360 can bias the piston 370 to keep the slips 340 in the engaged position, thereby providing an additional safety feature to prevent inadvertent release of the tubular string 210. Once the slips 340 are engaged with the tubular 130, the top drive 200 can be raised along with the cylindrical body 300. By raising the body 300, the wedge lock assembly 350 will further bias the slips 340. With the tubular 130 engaged by the top drive 200, the top drive can be relocated to align and thread the tubular with tubular string 210.

In another embodiment (not shown), a top drive 200 includes a gripping means for engaging a tubular on the outer surface. For example, the slips can be arranged to grip on the outer surface of the tubular, preferably gripping under the collar 380 of the tubular 130. In operation, the top drive is positioned over the desired tubular. The slips are then lowered by the top drive to engage the collar 380 of the tubular 130. Once the slips are positioned beneath the collar 380, the piston is actuated to cause the slips to grip the outer surface of the tubular 130. Sensors may be placed in the slips to ensure proper engagement of the tubular.

FIG. 5 is a flow chart illustrating a typical operation of a string or casing assembly using a top drive and a spider. The flow chart relates to the operation of an apparatus generally illustrated in FIG. 1B. At a first step 500, a tubular string 210 is retained in a closed spider 400 and is thereby prevented from moving in a downward direction. At step 510, top drive 200 is moved to engage a tubular 130 from a stack with the aid of an elevator 120. The tubular 130 may be a single tubular or could typically be made up of three tubulars threaded together to form a stack. Engagement of the tubular by the top drive includes grasping the tubular and engaging the inner surface thereof. At step 520, the top drive 200 moves the tubular 130 into position above the tubular string 210. At step 530, the top drive 200 threads the tubular 130 to tubular string 210. At step 540, the spider 400 is opened and disengages the tubular string 210. At step 550, the top drive 200 lowers the tubular string 210, including tubular 130 through the opened spider 400. At step 560 and the spider 400 is closed around the tubular string 210. At step 570 the top drive 200 disengages the tubular string and can proceed to add another tubular 130 to the tubular string 210 as in step 510. The above-described steps may be utilized in running drill string in a drilling operation or in running casing to reinforce the wellbore or for assembling strings to place wellbore components in the wellbore. The steps may also be reversed in order to disassemble the casing or tubular string.

Although the top drive is a good alternative to the Kelly and rotary table, the possibility of inadvertently dropping a tubular string into the wellbore exists. As noted above, a top drive and spider must work in tandem, that is, at least one of them must engage the tubular string at any given time during tubular assembly. Typically, an operator located on the platform controls the top drive and the spider with manually operated levers that control fluid power to the slips that cause the top drive and spider to retain a tubular string. At any given time, an operator can inadvertently drop the tubular string by moving the wrong lever. Conventional interlocking systems have been developed and used with elevator/spider systems to address this problem, but there remains a need for a workable interlock system usable with a top drive/spider system such as the one described herein.

There is a need therefore, for an interlock system for use with a top drive and spider to prevent inadvertent release of a tubular string. There is a further need for an interlock system to prevent the inadvertent dropping of a tubular or tubular string into a wellbore. There is also a need for an interlock system that prevents a spider or a top drive from disengaging a tubular string until the other component has engaged the tubular.

SUMMARY OF THE INVENTION

The present invention generally provides an apparatus and methods to prevent inadvertent release of a tubular or tubular string. In one aspect, the apparatus and methods disclosed herein ensure that either the top drive or the spider is engaged to the tubular before the other component is disengaged from the tubular. The interlock system is utilized with a spider and a top drive during assembly of a tubular string.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore, not to be considered limiting of its scope, for the invention may admit to other equally effective embodiments.

DETAILED DESCRIPTION OF THE PREFERRED EMBODIMENT

The present invention is an interlock system for use with a top drive and a spider during assembly of a string of tubulars. The invention may be utilized to assemble tubulars for different purposes including drill strings, strings of liner and casing and run-in strings for wellbore components.

Figure 6:
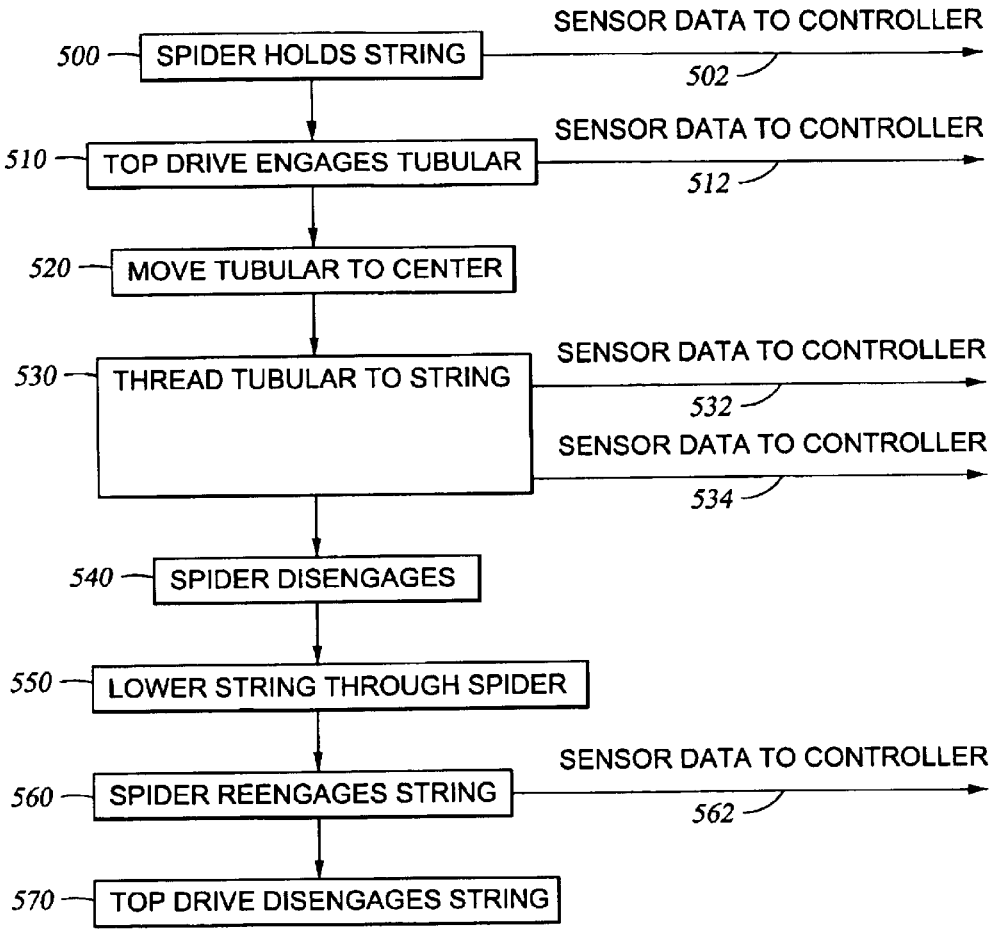
FIG. 6 shows a flow chart using an interlock system for a spider and a top drive.
Figure 7:
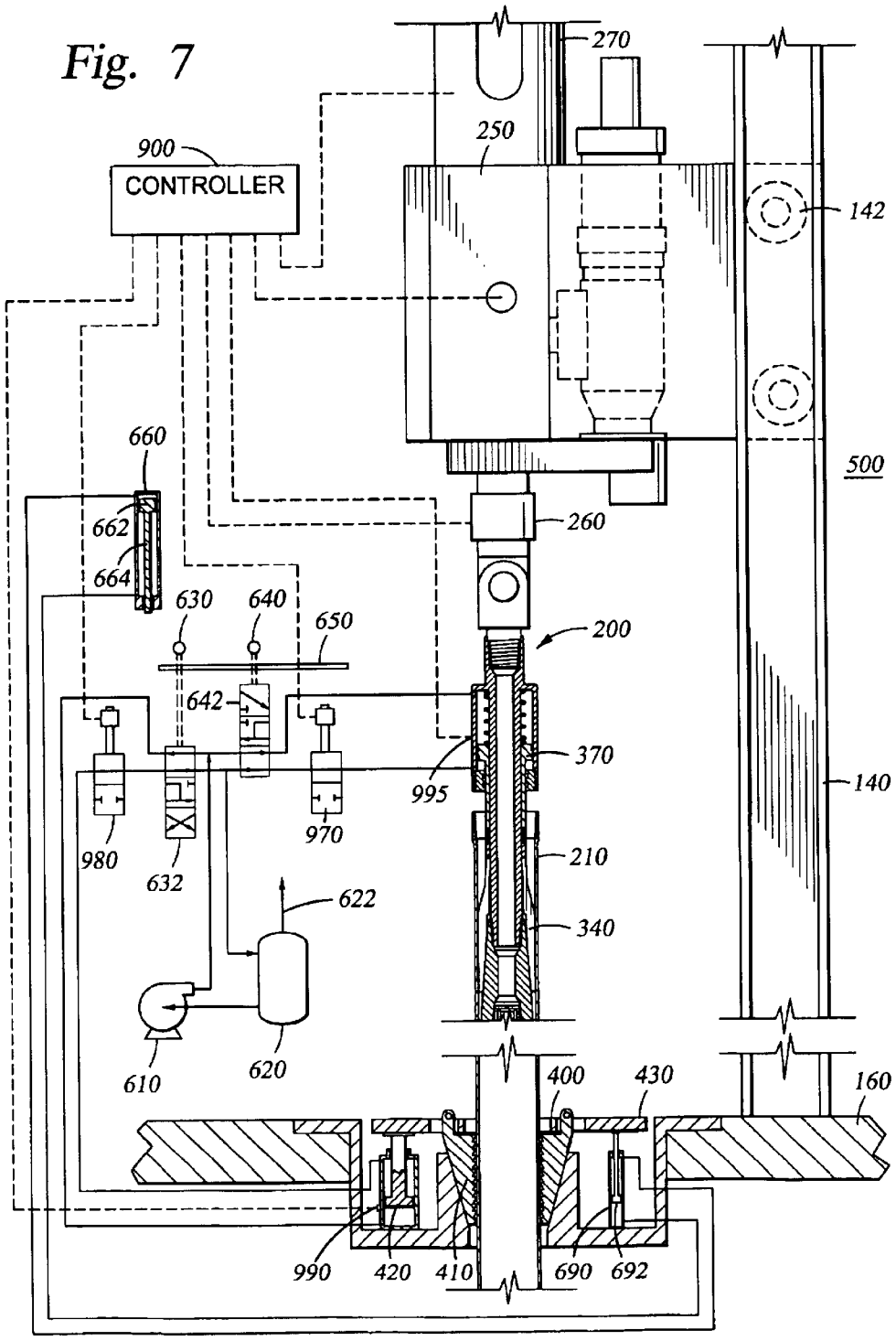
FIG. 7 illustrates the mechanics of the interlock system in use with a spider, a top drive and a controller.

FIG. 6 is a flow chart illustrating the use of an interlock system of the present invention with a spider and a top drive and FIG. 7 illustrates the mechanics of the interlock system in use with a spider, a top drive and a controller. At step 500, a tubular string 210 is retained in a closed spider 400 and prevented from moving in a downward direction. The spider includes a spider piston sensor located at a spider piston 420 to sense when the spider 400 is open or closed around the tubular string 210. The sensor data 502 is relayed to a controller 900.

A controller includes a programmable central processing unit that is operable with a memory, a mass storage device, an input control unit, and a display unit. Additionally, the controller includes well-known support circuits such as power supplies, clocks, cache, input/output circuits and the like. The controller is capable of receiving data from sensors and other devices and capable of controlling devices connected to it.

One of the functions of the controller 900 is to prevent opening of the spider. Preferably, the spider 400 is locked in the closed position by a solenoid valve 980 (FIG. 7) that is placed in the control line between the manually operated spider control lever 630 (FIG. 7) and the source of fluid power operating the spider. Specifically, the spider solenoid valve 980 controls the flow of fluid to the spider piston 420. The solenoid valve 980 is operated by the controller 900 and the controller is programmed to keep the valve closed until certain conditions are met. While valve 980 is electrically powered in the embodiment described herein, the valve could be fluidly or pneumatically powered so long as it is controllable by the controller 900. Typically, the valve 980 is closed and the spider 400 is locked until a tubular is successfully joined to the string and held by the top drive.

At step 510, the top drive 200 is moved to engage a pre-assembled tubular 130 from a stack with the aid of an elevator 120. A top drive sensor 995 (FIG. 7) is placed near a top drive piston 370 to sense when the top drive 200 is disengaged, or in this case engaged around the tubular 130. The sensor data 512 is relayed to the controller 900. At step 520, the top drive 200 moves the tubular 130 into position and alignment above the tubular string 210. At step 530, the top drive 200 rotationally engages the tubular 130 to tubular string 210, creating a threaded joint therebetween. Torque data 532 from a torque sub 260 and rotation data 534 from a counter 250 are sent to the controller 900.

The controller 900 is preprogrammed with acceptable values for rotation and torque for a particular connection. The controller 900 compares the rotation data 534 and the torque data 532 from the actual connections and determines if they are within the accepted values. If not, then the spider 400 remains locked and closed, and the tubular 130 can be rethreaded or some other remedial action can take place by sending a signal to an operator. If the values are acceptable, the controller 900 locks the top drive 200 in the engaged position via a top drive solenoid valve 970 (FIG. 7) that prevents manual control of the top drive 200. At step 540, the controller 900 unlocks the spider 400 via the spider solenoid valve, and allows fluid to power the piston 420 to open the spider 400 and disengage it from the tubular string 210. At step 550, the top drive 200 lowers the tubular string 210, including tubular 130 through the opened spider 400. At step 560, the spider 400 is closed around the tubular string 210. The spider sensor 990 (FIG. 7) signals the controller 900 that the spider 400 is closed. If no signal is received, then the top drive 200 stays locked and engaged to tubular string 210. If a signal is received confirming that the spider is closed, the controller locks the spider 400 in the closed position, and unlocks the top drive 200. At step 570 the top drive 200 can disengage the tubular string 210 and proceed to add another tubular 130. In this manner, at least the top drive or the spider is engaging the tubular string at all times.

Figure 1A:
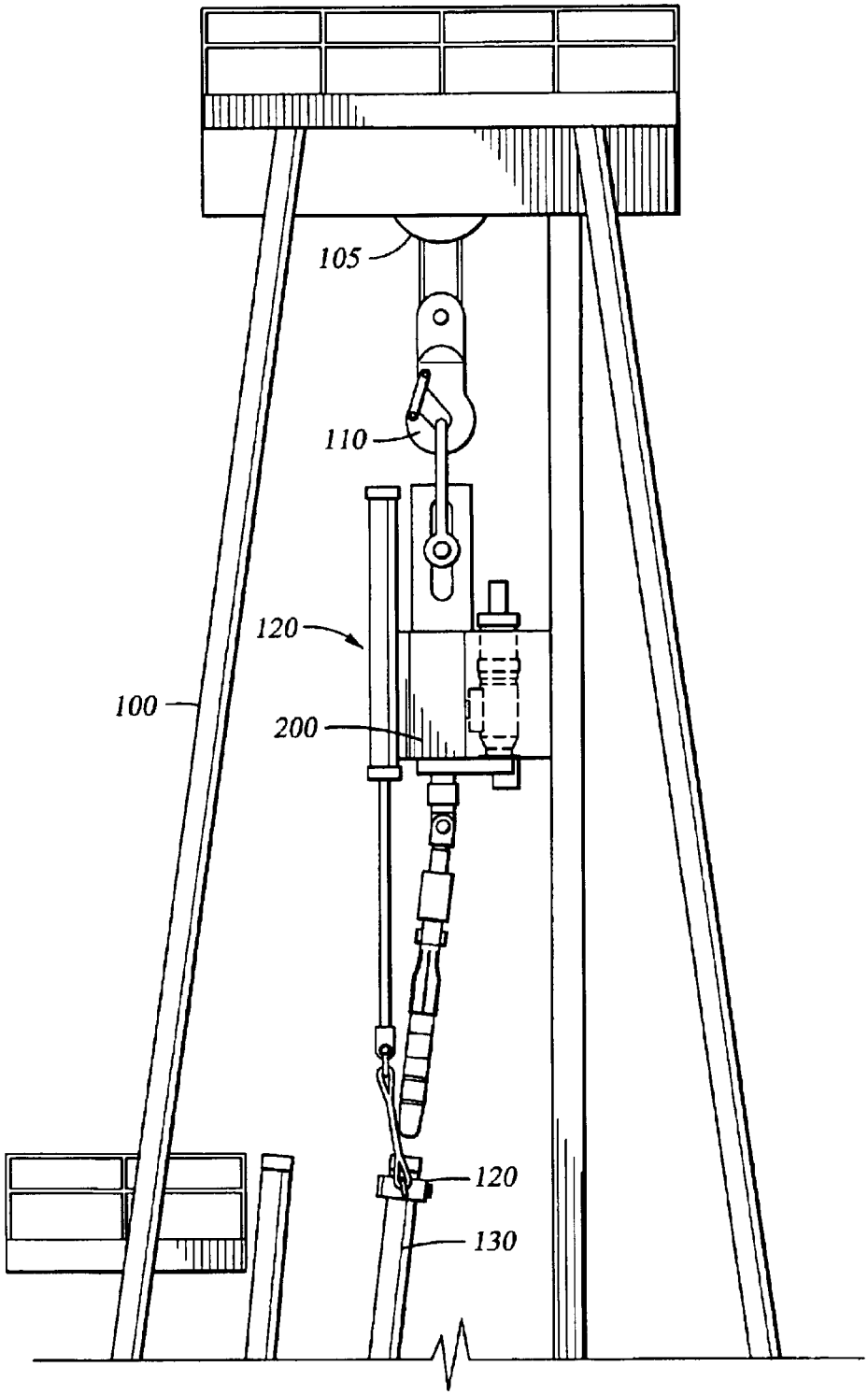
FIG. 1A is a side view of a drilling rig 100 having a top drive 200 and an elevator 120.
Figure 1B:
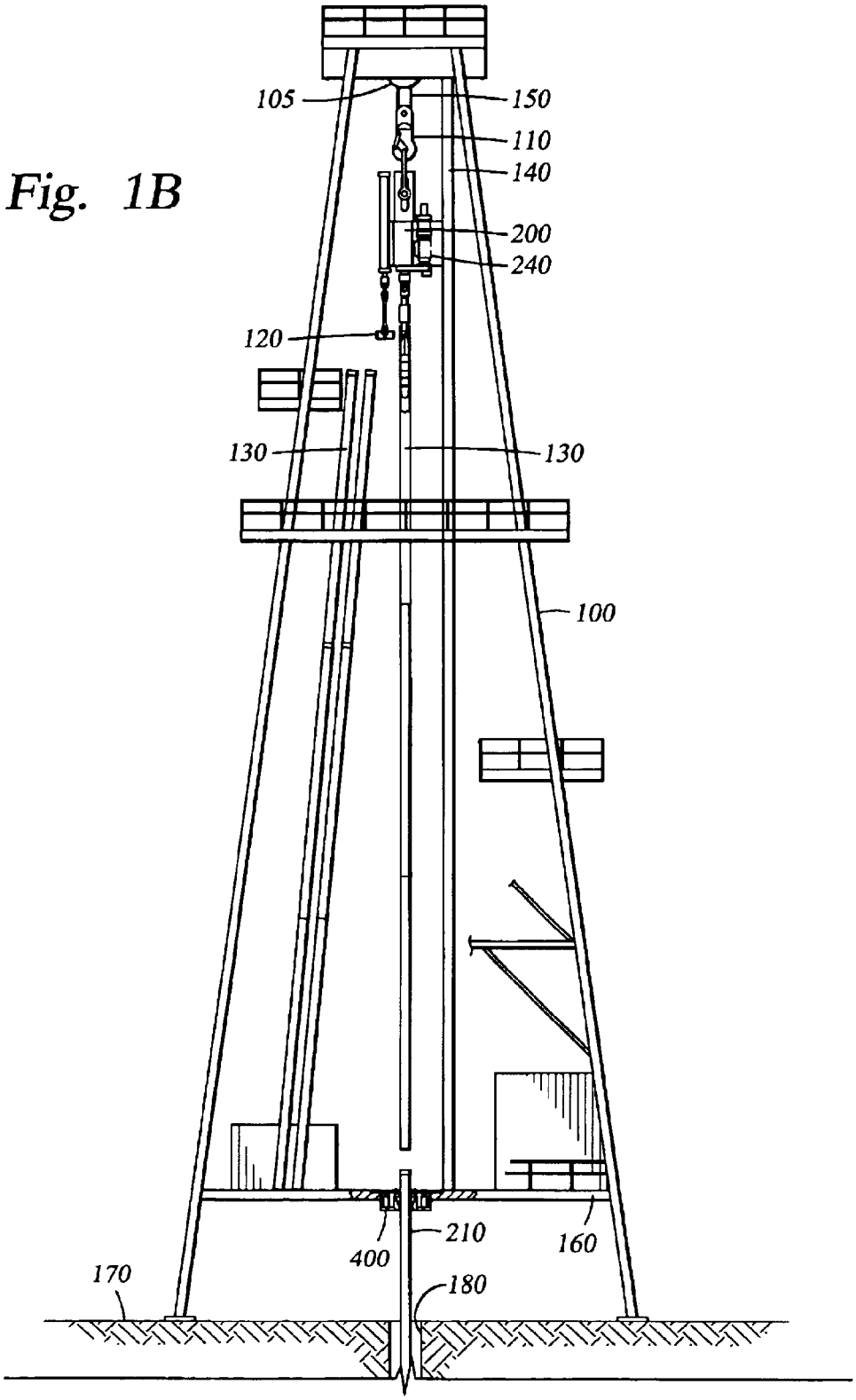
FIG. 1B is a side view of a drilling rig 100 having a top drive 200, an elevator 120, and a spider 400.
Figure 2:
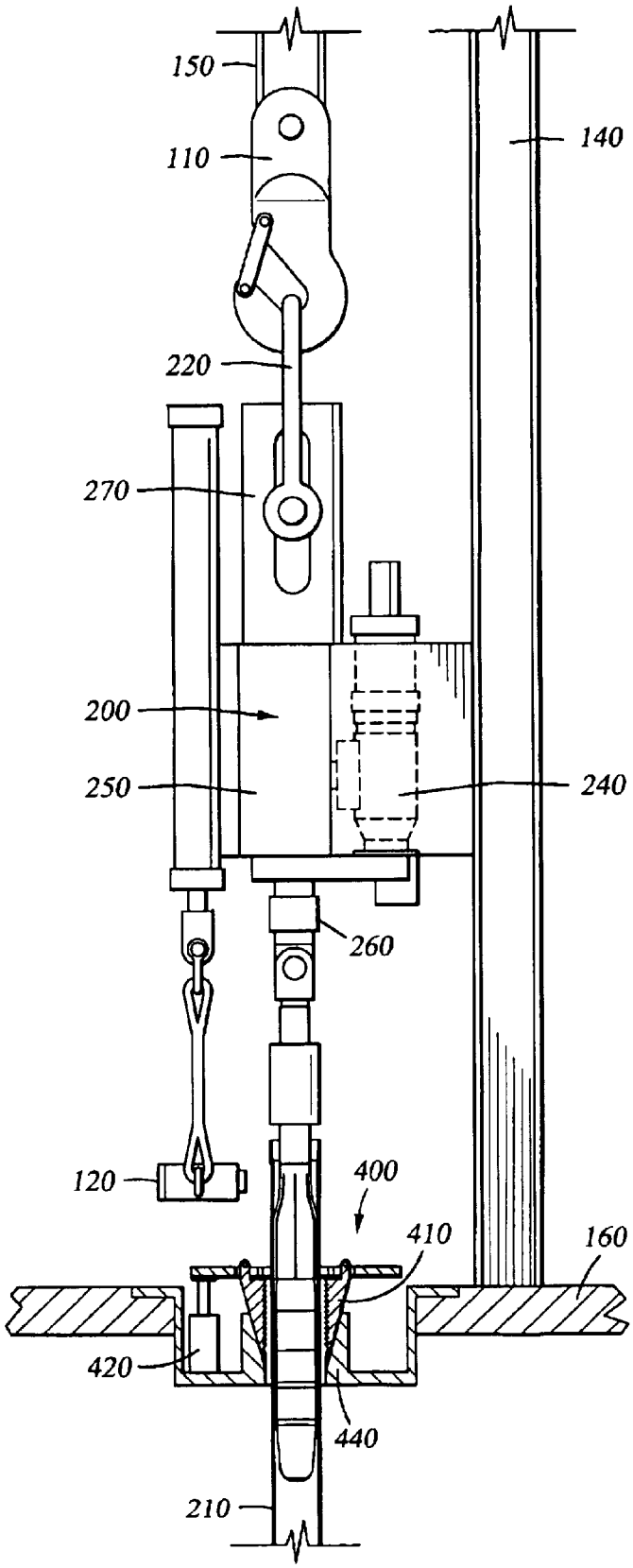
FIG. 2 illustrates a side view of a top drive engaged to a tubular, which has been lowered through a spider.
Figure 3:
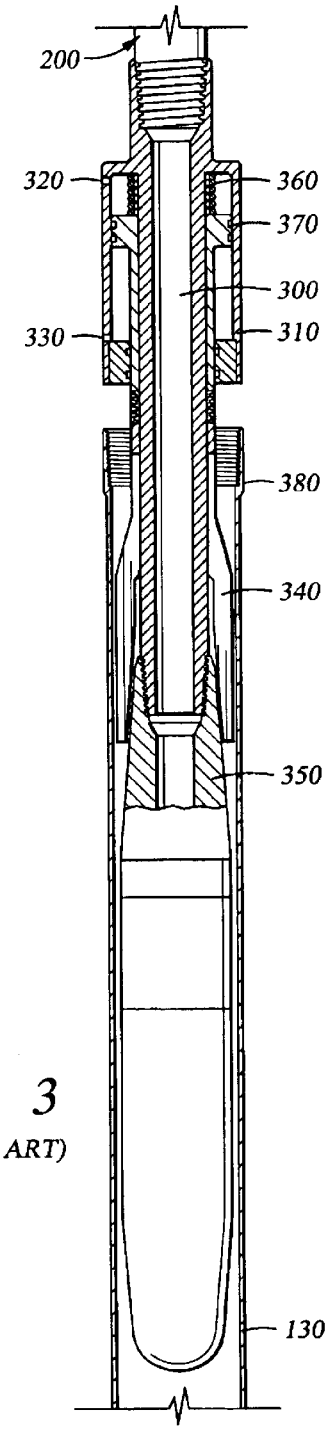
Fig. 3 (PRIOR ART)
FIG. 3 is cross-sectional view of a top drive 200 and a tubular 130.
Figure 4:
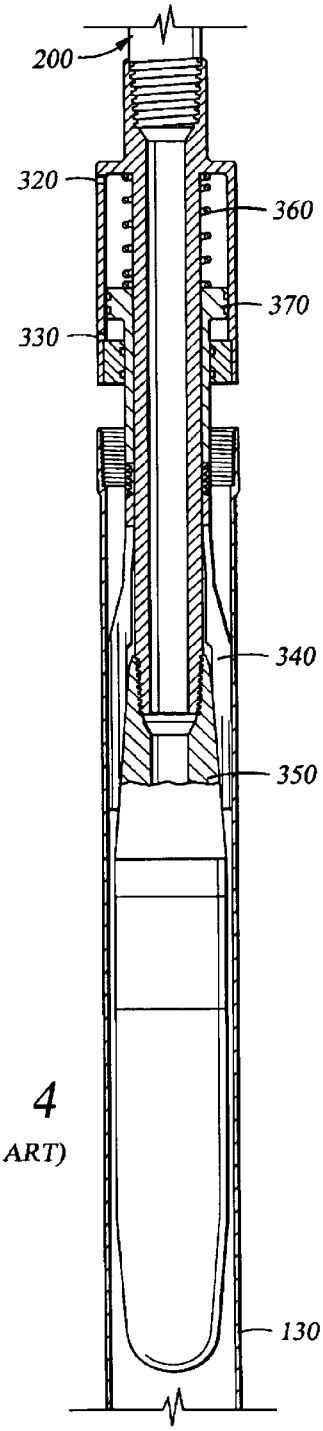
Fig. 4 (PRIOR ART)
FIG. 4 illustrates a cross-sectional view of a top drive 200 engaged to a tubular 130.
Figure 5:
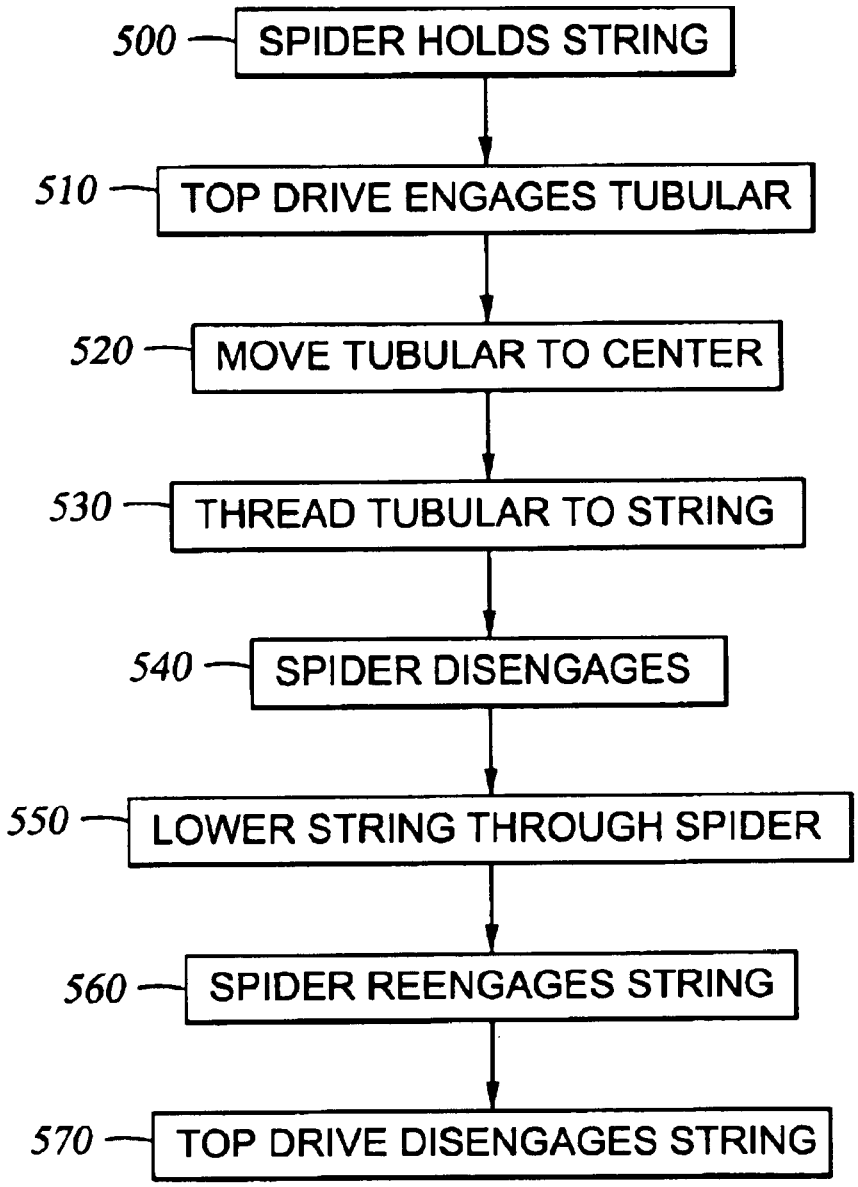
Fig. 5 (PRIOR ART)
FIG. 5 is a flow chart of a typical operation of tubular string or casing assembly using a top drive and a spider.

Alternatively, or in addition to the foregoing, a compensator 270 (shown in FIG. 2) may be utilized to gather additional information about the joint formed between the tubular and the tubular string. The compensator 270, in addition to allowing incremental movement of the top drive 200 during threading together of the tubulars, may be used to ensure that a threaded joint has been made and that the tubulars are mechanically connected together. For example, after a joint has been made between the tubular and the tubular string, the top drive may be raised or pulled up. If a joint has been formed between the tubular and the string, the compensator will "stoke out" completely, due the weight of the tubular string therebelow. If however, a joint has not been formed between the tubular and the string due to some malfunction of the top drive or misalignment between a tubular and a tubular string therebelow, the compensator will stroke out only a partial amount due to the relatively little weight applied thereto by the single tubular or tubular stack. A stretch sensor located adjacent the compensator, can sense the stretching of the compensator 270 and can relay the data to a controller 900. Once the controller 900 processes the data and confirms that the top drive is engaged to a complete tubular string, the top drive 200 is locked in the engaged position, and the next step 540 can proceed. If no signal is received, then the spider 400 remains locked and a signal maybe transmitted by the controller to an operator. During this "stretching" step, the spider 400 is not required to be unlocked and opened. The spider 400 and the slips 410 are constructed and arranged to prevent downward movement of the string but allow the tubular string 210 to be lifted up and moved axially in a vertical direction even though the spider is closed. When closed, the spider 400 will not allow the tubular string 210 to fall through its slips 410 due to friction and the shaped of the teeth on the spider slips.

The interlock system 500 is illustrated in FIG. 7 with the spider 400, the top drive 200, and the controller 900 including various control, signal, hydraulic, and sensor lines. The top drive 200 is shown engaged to a tubular string 210 and is coupled to a railing system 140. The railing system includes wheels 142 allowing the top drive to move axially. The spider 400 is shown disposed in the platform 160 and in the closed position around the tubular string 210. The spider 400 and the top drive 200 may be pneumatically actuated, however the spider and top drive discussed herein are hydraulically activated. Hydraulic fluid is supplied to a spider piston 420 via a spider control valve 632. The spider control valve 632 is a three-way valve and is operated by a spider lever 630.

Also shown in FIG. 7 is a sensor assembly 690 with a piston 692 coupled to spider slips 410 to detect when the spider 400 is open or closed. The sensor assembly 690 is in communication with a locking assembly 660, which along with a control plate 650 prevents the movement of the spider and top drive lever. The locking assembly 660 includes a piston 662 having a rod 664 at a first end. The rod 664 when extended, blocks the movement of the control plate 650 when the plate is in a first position. When the spider 400 is in the open position, the sensor assembly 690 communicates to the locking assembly 660 to move the rod 664 to block the control plate's 650 movement. When the spider 400 is in the closed position as shown, the rod 664 is retracted allowing the control plate 650 to move freely from the first to a second position. Additionally, the sensor assembly 660 can also be used with the top drive 200 as well in the same fashion. Similarly, hydraulic fluid is supplied to a top drive piston 370 via a top drive control valve 642 and hydraulic lines. The top drive control valve 642 is also a three-way valve and is operated by a top drive lever 640. A pump 610 is used to circulate fluid to the respective pistons 370, 420. A reservoir 620 is used to re-circulate hydraulic fluid and receive excess fluid. Excess gas in the reservoir 620 is vented 622.

Further shown in FIG. 7, controller 900 collects data from a top drive sensor 995 regarding the engagement of the top drive to the tubular string 210. Data regarding the position of the spider 400 is also provided to controller 900 from a spider sensor 990. The controller 900 controls fluid power to the top drive 200 and spider 400 via solenoid valves 970, 980, respectively.

In FIG. 7, the top drive 200 is engaged to tubular string 210 while the spider 400 is in the closed position around the same tubular string 210. At this point, steps 500, 510, 520, and 530 of FIG. 6 have occurred. Additionally, the controller 900 has determined through the data received from counter 250 and torque sub 260 that an acceptable threaded joint has been made between tubular 130 and tubular string 210. In the alternative or in addition to the foregoing, a compensator 270 can also provide data to the controller 900 that a threaded joint has been made and that the tubular 130 and the tubular string 210 are mechanically connected together via a stretch sensor (not shown). The controller 900 then sends a signal to a solenoid valve 970 to lock and keep a top drive piston 370 in the engaged position within the tubular string 210. Moving to step 540 (FIG. 6), the controller 900 can unlock the previously locked spider 400, by sending a signal to a solenoid valve 980. The spider 400 must be unlocked and opened in order for the top drive 200 to lower the tubular string 210 through the spider 400 and into a wellbore. An operator (not shown) can actuate a spider lever 630 that controls a spider valve 632, to allow the spider 400 to open and disengage the tubular string 210. When the spider lever 630 is actuated, the spider valve allows fluid to be flow to spider piston 420 causing spider slips 410 to open. With the spider 400 opened, a sensor assembly 690 in communication with a locking assembly 660 will cause a rod 664 to block the movement of a control plate 650. Because the plate 650 will be blocked in the rightmost position, the top drive lever 640 is held in the locked position and will be unable to move to the open position.

As illustrated in FIG. 7, the interlock system when used with the top drive and the spider prevents the operator from inadvertently dropping the tubular string into the wellbore. As disclosed herein, the tubular string at all times is either engaged by the top drive or the spider. Additionally, the controller prevents operation of the top drive under certain, even if the top drive control lever is actuated. Further, the interlock system provides a control plate to control the physical movement of levers between an open and closed, thereby preventing the operator from inadvertently actuating the wrong lever.

Figure 8:
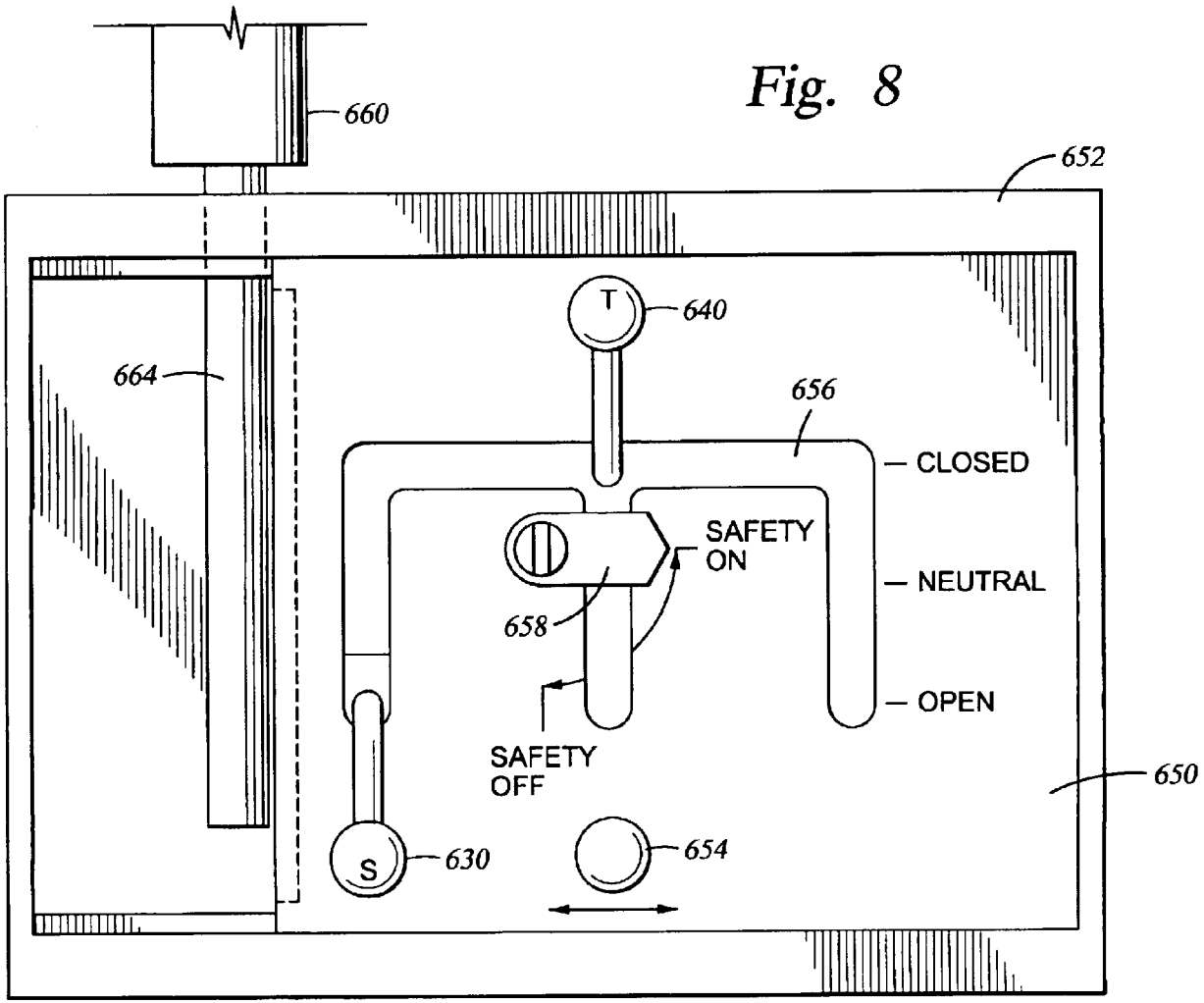
FIG. 8 illustrates a control plate for a spider lever and a top drive lever.

FIG. 8 illustrates a control plate for a spider lever and a top drive lever that can be used with the interlock system of the present invention. The control plate 650 is generally rectangular in shape and is provided with a series of slots 656 to control the movement of the spider lever 630, and the top drive lever 640. Typically, the control plate 650 is slideably mounted within a box 652. The slots 656 define the various positions in which the levers 630, 640 may be moved at various stages of the tubular assembly or disassembly. The levers 630, 640 can be moved in three positions: (1) a neutral position located in the center; (2) a closed position located at the top and causes the slips to close; and (3) an open position located at the bottom, which causes the slips to open. The control plate 650 can be moved from a first rightmost position to a second leftmost position with a knob 654. However, both levers 630, 640 must be in the closed position before the control plate is moved from one position to another. The control plate 650 is shown in the first rightmost position with a rod 664 extending from a locking assembly 660 to block the movement of the control plate. In operation, in the first rightmost position of the control plate 650, the spider lever 630 can be moved between the open and close positions, while the top drive lever 640 is kept in the closed position. In the second leftmost position, the top drive lever 640 can be moved between the open and close positions, while the spider lever 630 is kept in the closed position. A safety lock 658 is provided to allow the top drive or spider levers 630, 640 to open and override the control plate 650 when needed.

The interlock system may be any interlock system that allows a set of slips to disengage only when another set of slips is engaged to the tubular. The interlock system may be mechanically, electrically, hydraulically, pneumatically actuated systems. The spider may be any spider that functions to hold a tubular or a tubular string at the surface of the wellbore. A top drive may be any system that can grab a tubular by the inner or outer surface and can rotate the tubular. The top drive can also be hydraulically or pneumatically activated.

While the foregoing is directed to the preferred embodiment of the present invention, other and further embodiments of the invention may be devised without departing from the basic scope thereof, and the scope thereof is determined by the claims that follow.

What is claimed is:

1. An apparatus for use with tubulars, comprising:

a spider having a set of slips for gripping the tubulars;

a top drive disposable above the spider for gripping the tubulars; and an interlock system to ensure that a tubular string is gripped by one of the top drive and the spider, wherein the interlock system prevents the top drive from disengaging the tubular string, unless the spider is engaged around the tubular string.

2. The apparatus of claim 1, wherein the top drive comprises:

a body having a slip assembly disposed on a surface;

the slip assembly temporarily engaging a surface of a first end of a tubular;

a motor to provide rotational movement to the tubulars; and a compensator disposed on the top drive thereby allowing incremental axial movement of the tubular.

3. An apparatus for use with tubulars, comprising:

a spider having a set of slips for gripping the tubulars;

a top drive disposable above the spider for gripping the tubulars; and an interlock system to ensure that a tubular string is gripped by one of the top drive and the spider, wherein the interlock system prevents the spider from disengaging the tubular string, unless the top drive is engaged to the tubular string.

4. An apparatus for use with tubulars, comprising:

a spider having a set of slips for gripping the tubulars;

a top drive disposable above the spider for gripping the tubulars; and an interlock system to ensure that a tubular string is gripped by one of the top drive and the spider, wherein the interlock system includes a controller.

5. The apparatus of claim 4, wherein the controller collects data relating to a joint formed between the tubulars.

6. The apparatus of claim 5 wherein the data is generated by a torque sub disposed adjacent the top drive.

7. The apparatus of claim 6, wherein the data further relates to torque generated in the joint.

8. The apparatus of claim 5, wherein the data is generated by a revolution counter.

9. The apparatus of claim 8, wherein the data further relates to the number of tubular rotations making up the joint.

10. The apparatus of claim 5, wherein the controller compares the data to pre-stored values defining an acceptable joint.

11. The apparatus of claim 10, wherein the interlock system further includes at least one valve to enable and lock out controls for the top drive and the spider, the valve controllable by the controller based upon the data.

12. The apparatus of claim 11, wherein the interlock system further comprises:

a physical barrier to control the movement of manual controls controlling the top drive and the spider to engage and release the tubular string; and a sensor assembly in communication with the spider and a locking assembly, the sensor assembly senses the engagement of the spider and relays the information to the locking assembly, which controls the movement of the physical barrier.

13. The apparatus of claim 5, wherein the data is generated from a compensator relating to the axial movement of the compensator during make up of the joint.

14. An apparatus for assembling and disassembly tubulars, comprising:

a first member having a motor for rotating and joining tubulars at a joint and forming a tubular string therefrom, and a cylindrical body having a first set of slips and a wedge lock assembly disposed on the cylindrical body, the first set of slips is coupled to a piston that is coupled to a resilient member;

a second member having a piston coupled to a second set of slips; and an interlock system.

15. The apparatus of claim 14, wherein the first set of slips can engage an inner surface of the tubulars.

16. The apparatus of claim 14, wherein a first member sensor is coupled to the first member and a second member sensor is coupled to the second member.

17. The apparatus of claim 14, wherein the first member further comprises:

a counter providing data relating to the tubular rotations making up the joint;

a torque sub providing data relating to the amount of torque placed during joining of the tubulars; and a compensator coupling the first member to a rig and providing data regarding whether the first member is engaging the tubular string.

18. The apparatus of claim 17, wherein the first member is a top drive and is coupled to a railing system mounted on the rig.

19. The apparatus of claim 17, wherein the second member is coupled to a platform of the rig.

20. The apparatus of claim 17, wherein the interlock system further comprises:

a sensor assembly in communication with the second set of slips;

a locking assembly in communication with the sensor assembly;

a control plate having a first member lever controlling a first member valve, a second member lever controlling a second member valve, the movement of the control plate is controlled by the locking assembly; and a controller in communication with a first member sensor coupled to the first member and a second member sensor coupled to the second member, the torque sub, the counter, and a first and second member solenoid valves.

21. The apparatus of claim 20, wherein the controller is also in communication with the compensator.

22. The apparatus of claim 14, wherein the second member is a spider.

23. A method for use with assembling and dissembling a tubular string formed by a first tubular and a second tubular, comprising:

engaging a first apparatus to the first tubular;

engaging a second apparatus to the second tubular;

joining the first tubular to the second tubular thereby forming the tubular string;

providing an interlock system to ensure that at least the first apparatus or the second apparatus is engaging the tubular string;

opening the second apparatus to disengage the second apparatus from the second tubular;

lowering the tubular string;

engaging the second apparatus to the tubular string; and disengaging the first apparatus from the first tubular, wherein the first apparatus includes a motor for joining the tubulars and at least a first set of slips, and the second apparatus having at least a second set of slips.

24. The method of claim 23, wherein the first set of slips can engage an inner surface of the first tubular.

25. The method of claim 23, wherein the interlock system prevents the first set of slips from disengaging the tubular string, unless the second set of slips is closed around the tubular string.

26. The method of claim 25, wherein the interlock system prevents the second set of slips from opening or disengaging the tubular string, unless the first set of slips are engaged to the tubular string.

27. The method of claim 23, wherein the first apparatus is a top drive and the second apparatus is a spider.

28. An apparatus for use with a tubular string formed by connecting a first tubular and a second tubular, comprising:

a top drive for gripping and rotating the first tubular;

a second device for gripping the second tubular; and an interlock system operatively connected to the first and second devices to ensure that the tubular string is gripped by at least one of the first and second devices.

29. The apparatus of claim 28, wherein the first device comprises:

a body having a slip assembly;

a motor to provide rotational movement to the first tubular; and a compensator to allow incremental axial movement of the first tubular.

30. The apparatus of claim 28, wherein the interlock system further comprises a controller.

31. The apparatus of claim 30, wherein the controller collects data relating to a joint formed on the tubular string.

32. The apparatus of claim 31, wherein the controller compares the data to pre-stored values defining an acceptable joint.

33. The apparatus of claim 32, wherein the interlock system further includes at least one valve to enable and lock out controls for the first device and the second device, the valve controllable by the controller based upon the data.

* * * * *